United States Patent [19]

Ohude et al.

[11] 4,363,204

[45] Dec. 14, 1982

[54] APPARATUS FOR SIMULTANEOUS OPERATION OF UNCASING AND CAP REMOVING

[75] Inventors: Masao Ohude, Kanazawa; Duro Kawamura, Uchinada, both of Japan

[73] Assignee: Shibuya Kogyo Co., Ltd., Ishikawa, Japan

[21] Appl. No.: 175,748

[22] Filed: Aug. 6, 1980

[30] Foreign Application Priority Data

Aug. 13, 1979 [JP] Japan ..... 54-102947

[51] Int. Cl.[3] ..... B67B 7/16

[52] U.S. Cl. ..... 53/381 A; 414/416; 141/170; 141/350

[58] Field of Search ..... 414/411, 744 A, 416; 15/59, 60; 134/62, 63, 152; 141/170, 154, 350; 81/3.2, 3.32, 3.1 R; 53/381 A, 251

[56] References Cited

U.S. PATENT DOCUMENTS 2,862,634 12/1958 Chalich ..... 414/416
2,863,579 12/1958 Meyer ..... 414/416
3,185,328 5/1965 Dardaine et al. ..... 414/416
3,405,500 10/1968 Rupert ..... 141/170 X
3,803,795 4/1974 Ouellette ..... 53/381 A X
3,870,175 3/1975 Dilanni ..... 81/3.2

*Primary Examiner*—John J. Love
*Assistant Examiner*—L. E. Williams
*Attorney, Agent, or Firm*—Majestic, Gallagher, Parsons & Siebert

[57] ABSTRACT

At a first position, bottles are stored in a box, and the bottles are taken out of the box at the first position and transferred to a second position. If the bottles are capped, all the caps are removed during the above-mentioned uncasing operation so that all the bottles placed at the second position are uncapped. In this manner, an uncasing operation and a cap removing operation take place simultaneously. The present apparatus comprises a holding head unit which makes a reciprocating motion between the first and the second positions. The holding head unit is provided with bottle grippers and cap removers. The cap removers are movable with respect to the bottles for uncapping.

8 Claims, 10 Drawing Figures

APPARATUS FOR SIMULTANEOUS OPERATION OF UNCASING AND CAP REMOVING

BACKGROUND OF THE INVENTION

This invention relates to a method and apparatus for simultaneous operation of uncasing and cap removing, in which containers, such as bottles, loaded in a box, such as a cartone, are taken out of the box and transferred to a desired position in a bottle handling line during which caps, such as crown caps, attached to the mouth of the bottles, if any, are removed.

Conventionally, use has been made of an uncasing machine for unloading a box, or taking bottles out of a box, and transferring the bottles to a desired position. On the other hand, since it is often the case that some or all of the bottles loaded in a box are attached with crown caps on top, a cap removing machine has been used to remove such caps before feeding the bottles to a next step of operation such as bottle washing. Thus, in accordance with the prior art technique, a cap ramoving machine and an uncasing machine have to be provided one after another, which necessarily makes the entire bottle handling line longer and requires a larger space for installment. Furthermore, since two separate machines are operated in the same bottle handling line, it is required to provide a system for taking synchronization in operation between the two, which brings about complication in wiring between components and designing an entire bottle handling line.

SUMMARY OF THE INVENTION

A primary object of the present invention is to provide a method and apparatus which enables to carry out a bottle handling operation efficiently.

It is another object of the present invention to provide a method and apparatus for carrying out an uncasing operation to take bottles out of a box at a first position and transfer the bottles to a second position, during which caps attached to the bottles, if any, are removed.

It is a further object of the present invention to shorten the length of a bottle handling line by carrying out an uncasing operation and a cap removing operation at the same time.

It is still a further object of the present invention to provide apparatus comprising bottle grippers and cap removers wherein cap removers are movable with respect to bottles having caps, if any, on top to carry out a cap removing operation.

It is still a further object of the present invention to provide apparatus for simultaneous operation of uncasing and cap removing which is relatively simple in structure and reliable in operation.

Other objects, advantages and novel features of the present invention will become apparent from the following detailed description of the invention when considered in conjunction with the accompanying drawings.

DESCRIPTION OF THE PREFERRED EMBODIMENTS

Figure 1:
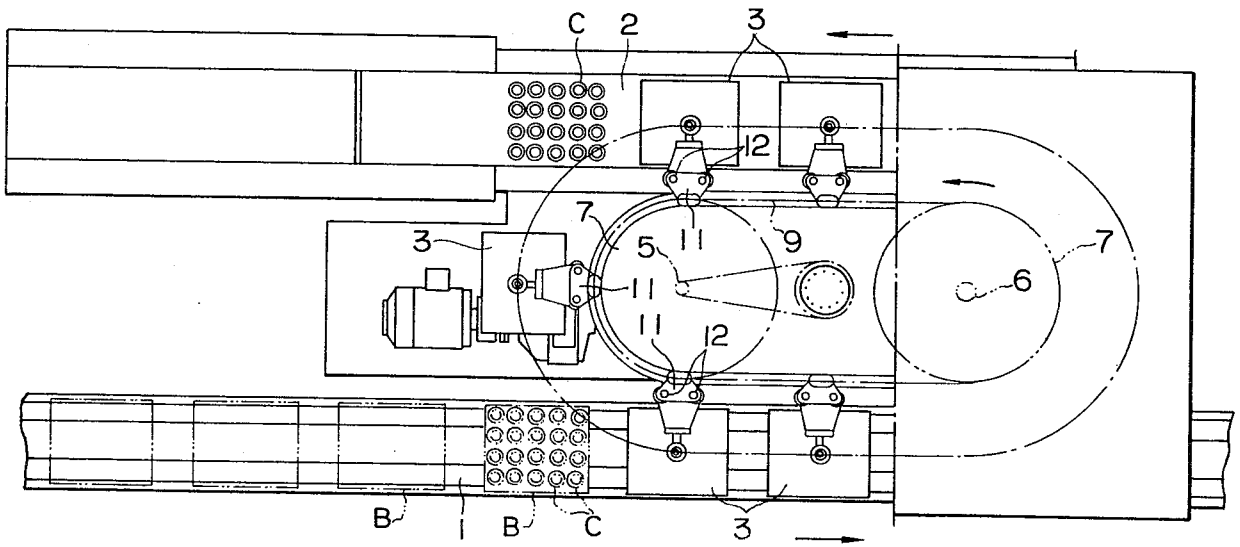
FIG. 1 is a plan view showing one embodiment of the present invention.
Figure 2:
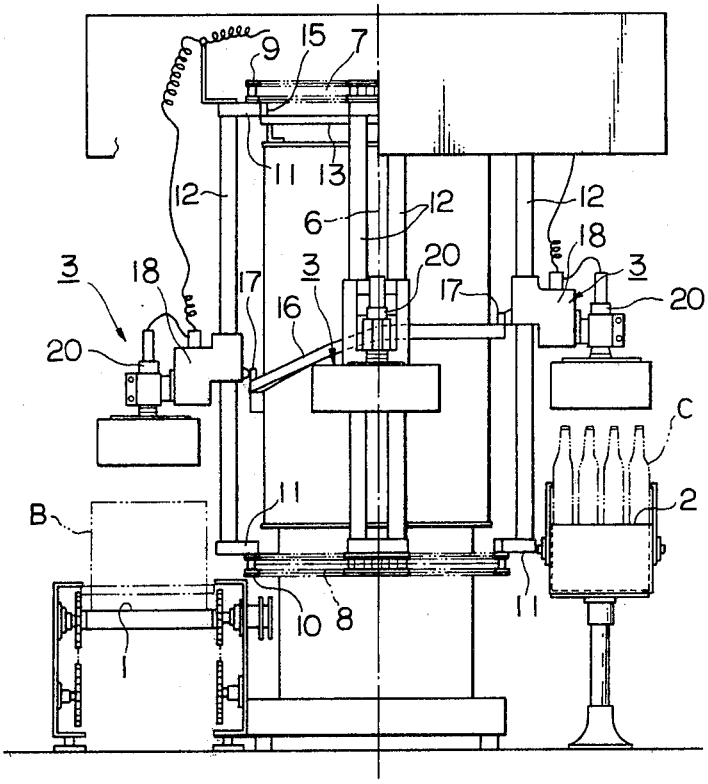
FIG. 2 is a side elevational view of the apparatus shown in FIG. 1.
Figure 3:
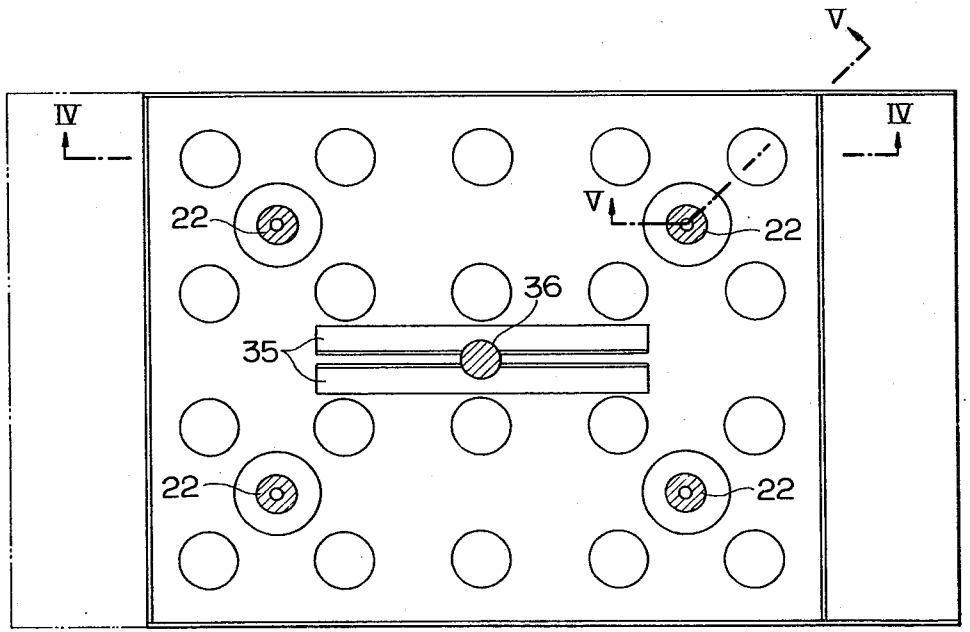
FIG. 3 is a partially cross-sectional plan view of a holding head unit constituting a part of the present invention.

Referring to FIGS. 1 and 2, a plurality of boxes B, in which bottles C are loaded, are transported spaced apart from one another at a predetermined distance as riding on a first belt conveyor 1. Parallel to the first belt conveyor 1 is provided a second belt conveyor 2, the transportation direction of which is oppposite to that of the first conveyor 1. Interposed between the first and the second conveyors 1,2 is an uncasing apparatus embodying the present invention; and, therefore, the bottles C stored in a box B on the first conveyor 1 are taken out of the box at a predetermined position and transfered onto the second conveyor 2 for further processing.

In the present uncasing apparatus, a pair of rotary shafts 5,6 are vertically provided between the first and the second conveyors 1,2 and each of the rotary shafts 5,6 is fixedly provided with two sprockets 7,8 one at a top and the other at a bottom. A chain 9 is extended between the two top sprockets 7,7; whereas a chain 10 is extended between the two bottom sprockets 8,8. Each of the chains 9,10 is provided with a plurality of brackets 11 spaced apart from one another at a predetermined distance, and a pair of guide rods 12,12 are fixedly mounted between the corresponding top and bottom brackets 11,11. A holding head unit 3 is so provided that it may move up and down along the guided rod pair 12,12. The holding head unit 3 is provided with a roller 17 which can roll along a cam rail 16 structured in an intended shape. As a result, the upward or downward motion of the holding head unit 3 is regulated by the shape of the cam rail 16 and guided by the guide rod pair 12,12. More specifically, the vertical motion of the holding head unit 3 is designed such that it moves downward at a first predetermined position along the first conveyor 1 to grip bottles C in a box B and then moves upward to take the bottles C out of the box B, and when the bottles C are transferred to a second predetermined position along the second conveyor 2, it again moves down to place and release the bottles C on the second conveyor 2. As shown in FIG. 2, it should be noted that a support plate 13 is disposed along and below the top chain 9, and a roller 15 rotatably mounted on the top bracket 11 can roll on the support plate 13. Accordingly, a combined weight of the brackets 11, guide rods 12 and chains 10 is supported by the support weight 13.

Now, referring to FIGS. 3 to 6, explanation will be had with respect to the structure of one example of the holding head unit 3. The holding head unit 3 generally comprises an arm 18 slidingly movable along the guide rod pair 12,12, a double-acting cylinder actuator 20 fixedly mounted on the arm 18, and three separate plates 21,23 and 24 which are individually connected to respective portions of the cylinder actuator 20. That is, a top plate 21 is fixed to the cylinder portion of the cylinder actuator 20, and a bottom plate 23 provided with a plurality of bottle grippers 27 is fixedly connected in a parallel arrangement to the top plate 21 through a connection rod 22. Interposed between the top plate 21 and the bottom plate 23 is an intermediate plate 24 which is provided with a plurality of cap removers 30, corresponding in number to the bottle grippers 27, and which is connected to a piston rod 36 of the cylinder actuator 20. Therefore, the intermediate plate 24 can change its position with respect to and between the plates 21 and 23 by operating the cylinder actuator 20.

It is preferable to provide the bottle grippers 27 corresponding in number to the bottles C stored in a box B. Each bottle gripper 27 comprises a cylinder 25 into which the top portion of a bottle C may be inserted and an elastic member 26 mounted on the inner surface of the cylinder 25. The bottom end of the cylinder 25 may come into contact with the shoulder of the bottle C. The elestic member 26 is connected to a compressed air source (not shown) and the elastic member 26 expands to grip a bottle C when supplied with a compressed air. The connection between the elastic member 26 and a compressed air source (not shown) may be made for example for providing a through-hole in the connection rod 22 as shown by the arrow in FIG. 5.

The intermediate plate 24 is provided with a plurality of cap removers 30, corresponding in number to the bottle grippers 27 of the bottom plate 23. Each cap remover 30 comprises coaxially aligned outer and inner rings 31,32, a plurality of grip fingers 33 circumferentially arranged with their top ends pinched between the outer and inner rings 31,32, and a resilient ring 34 fitted onto the outer cylindrical surface formed by the grip fingers 33. With such a structure, since the grip fingers 33 are pinched between the outer and inner rings 31,32, they may be pivoted in the radial direction against the recovery force of the resilient ring 34, thereby blooming the bottom portions of the grip fingers 33. Each grip finger 33 is provided with a tapered surface 33A formed at the bottom end. This tapered surface 33A is quite useful as a guide when the top portion of a bottle C is inserted into the cap remover 30, or the circumferentially arranged grip fingers 33. Moreover, an inwardly projecting hook portion 33B is formed at an appropriate position of each grip finger 33. The hook portion 33B comes into engagement with a crown cap 40 attached on top of a bottle C when the cap remover 30 is pulled upward with respect to the bottle C. Then, a further upward motion of the cap remover 30 causes the crown cap 40 to be removed from the bottle C.

A cap store chamber 37 is defined between the top plate 21 and the intermediate plate 24, in which removed crown caps 40 are temporarily stored. Upon accumulation of certain number of removed crown caps 40, a signal is fed to the double acting cylinder actuator 38 so that the piston rod **38*a* extends. As the piston rod 38*a* extends, the crown caps 40 in the store chamber 37 are pushed by a pusher plate 38*b* into a predetermined direction, and, therefore, the crown caps 40 are discharged by opening an exit wall 39** which is pivoted at its top portion.

Figure 4:
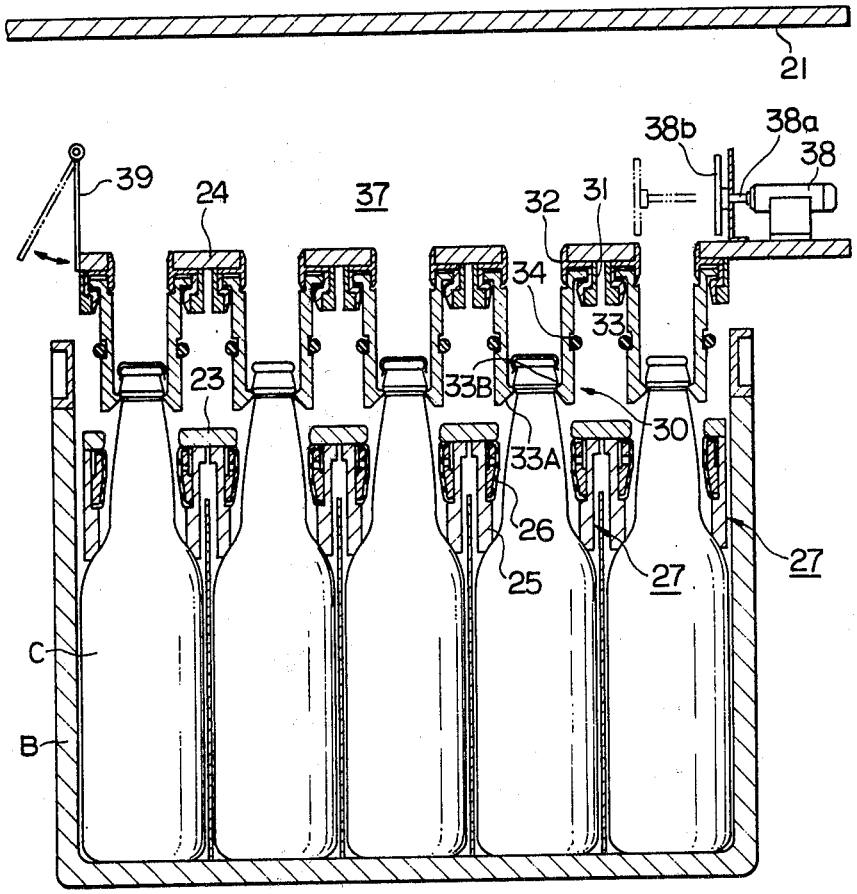
FIG. 4 is a cross-sectional view taken along IV—IV line shown in FIG. 3.
Figure 5:
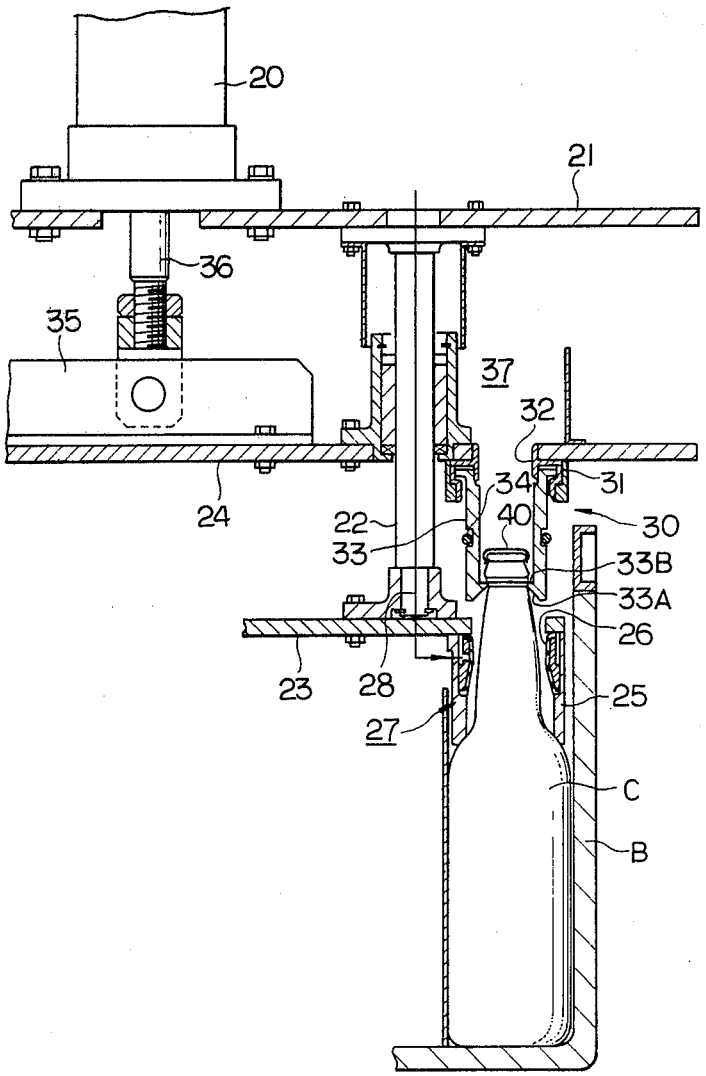
FIG. 5 is a cross-sectional view taken along V—V line shown in FIG. 3.

Now, explanation will be had with respect to one mode of operation of the present apparatus. By the cooperation between the roller 17 and the cam rail 16, the holding head unit 3 descends at a predetermined position along the first conveyor 1, the state of which is shown in FIGS. 4 and 5. As is apparent from these figures, the bottom ends of the cylinders 25 of the bottle grippers 27 are in contact with the shoulders of the respective bottles C, whereby the bottles C are temporarily held at their current positions. It is to be noted that compressed air has not yet been supplied to the elastic member 26. Therefore and since the piston rod 36 is at its advanced position, the top portions of the bottles C are inserted into the respective cap removers 30 as the holding head unit 3 descends. More in detail, as the cap removers 30 come down, the tapered surfaces 33A of the grip fingers 33 come into contact with the top ends, or crown caps 40, if any, of the bottles C stored in a box B. A further lowering of the cap removers 30 causes the grip fingers 33 to open or bloom against the recovery force of the resilient ring 34 as guided by the tapered surfaces 33A. Thus, the tapered surfaces 33A ensure that the top portions of bottles C are properly inserted into the respective cap removers 30. It should be noted here that the amount of insertion is such that it is deep enough to locate the hook portions 33B of the grip fingers 33 below crown caps 40 if attached on top of the bottles C.

Figure 6:
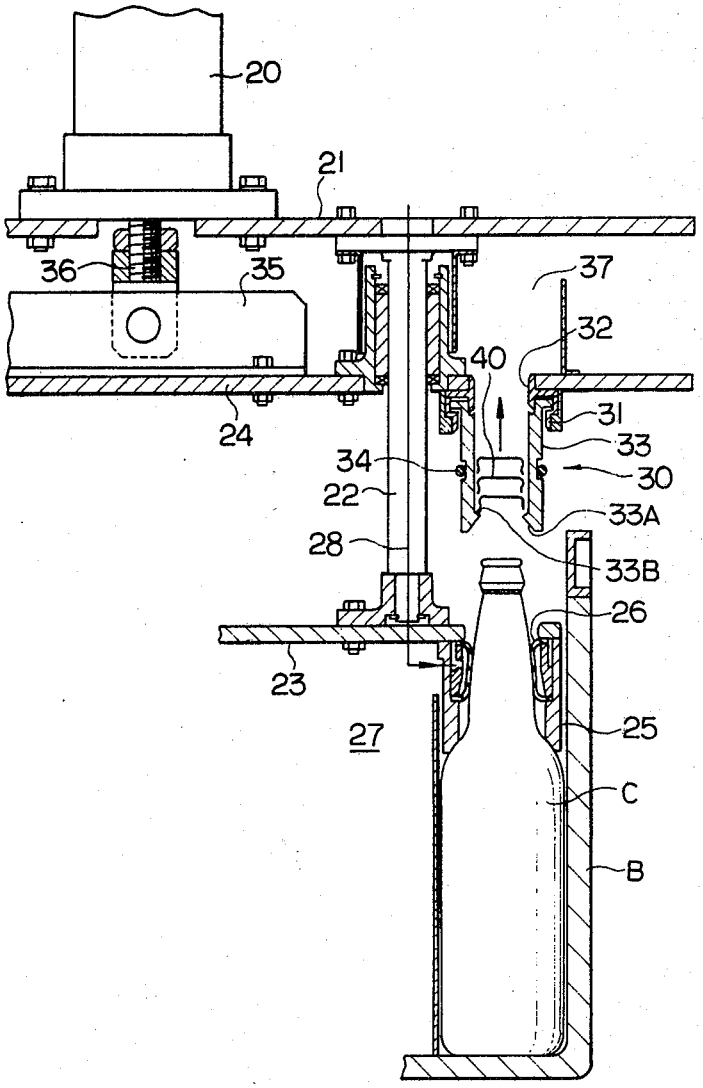
FIG. 6 is a cross-sectional view showing a state different from the one shown in FIG. 5.

Now, referring to FIG. 6, when the cylinder actuator 20 is operated to retract the piston rod 36, the intermediate plate 24 ascends with respect to the bottom plate 23. Thus, the cap removers 30 move upward to bring the hook portions 33B into engagement with crown caps 40 attached on top of the bottles C. A further upward motion of the cap removers tends to lift the bottles C. However, since the bottles C are temporarily held stationary owing to the contact between the cylinders 27 and the shoulders of the bottles C, only the crown caps 40 are lifted and, therefore, removed from the bottles C.

Subsequent thereto, compressed air is supplied to the elastic members 26 to grip the bottles C by the bottle grippers, and the holding head unit 3 starts to move upward due to the cooperation between the roller 17 and the cam rail 16. In this manner, the bottles C are taken out of a box B. The bottles C thus taken out are then brought toward the second conveyor 2 and placed thereon. The compressed air is then discharged from the elastic member 26 to release the bottles from the bottle grippers 27. So, when the holding head unit 3 moves up again, the bottles C now ride on the second conveyor without constraint.

In the above-described mode of operation, crown caps 40 are removed from the bottles C by moving the cap removers 30 upward while keeping the bottles C stationary by means of the cylinders 25. Thereafter, compressed air is supplied to the elastic members 26 to grip the bottles C and then the holding head unit 3 is moved upward to take the bottles C out of a box B. However, it should be noted that the present invention is not limited to the above-described mode of operation, and there are other modes of operation. For example, it is also possible to supply compressed air to the elastic members 26 to grip bottles C when the bottle grippers 27 come to a desired position by lowering the holding head unit 3, and then the cap removers 30 are moved upward to remove crown caps 40. Furthermore, in this instance, if the bottles C are gripped strongly enough by the elastic members 26, it is not always necessary to bring the bottom ends of the cylinders 27 in contact with the shoulders of the bottles C. Alternatively, it is also possible to carry out the cap removing operation during the transfer of the bottles C to the second conveyor 2 after having been taken out of a box B. Thus, it should be appreciated that the main feature of the present invention is to remove crown caps 40 attached to bottles C during an uncasing operation, in which the bottles C stored in a box B transported as riding on the first conveyor 1 are taken out and transferred onto the second conveyor 2.

In the embodiment shown in FIGS. 5 and 6, the plate 24 is moved by means of the double-acting cylinder actuator 20 with respect to the plate 23 to carry out a cap removing operation. Such a structure makes it possible to secure an appropriate operation all the time by changing the stroke of the piston rod 36 even if the height of the bottles C changes.

Figure 7:
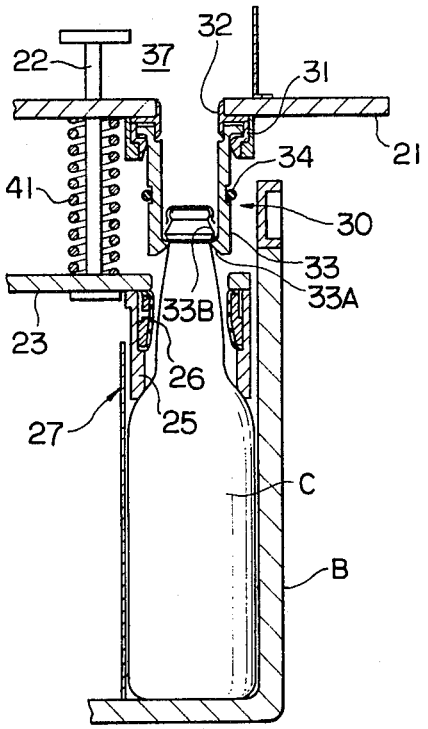
FIG. 7 is a cross-sectional view showing a part of another embodiment in accordance with the present invention.
Figure 8:
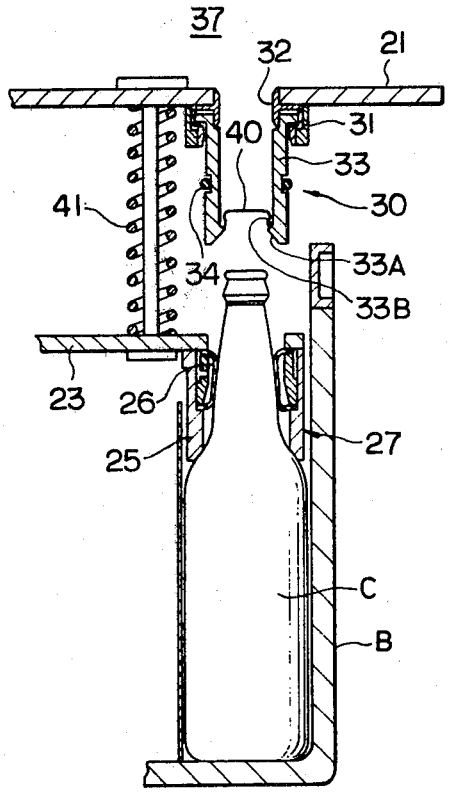
FIG. 8 is a cross-sectional view showing a state different from the one shown in FIG. 1.

Referring to FIGS. 7 and 8, there is shown another embodiment of the present invention, which is capable of carrying out a cap removing operation without the use of a double-acting cylinder actuator. As shown in FIGS. 7 and 8, use is not made of an intermediate plate but only a top plate 21 and a bottom plate 23 are provided. The top plate 21 is provided with a plurality of cap removers 30; while, the bottom plate is provided with a plurality of bottle grippers 27. The top plate 21 and the bottom plate 23 are connected by a connection rod 22; however, it should be noted that the two plates 21,23 are not connected fixedly, but, as shown in FIG. 7, they may change their positions with respect to each other against the recovery force of a coil spring 41 interposed therebetween.

Now, the operation of the embodiment shown in FIGS. 7 and 8 will be explained. As the holding head unit 3 moves downward above the first conveyor 1 by the cooperation between the roller 17 and the cam rail 16, the bottom ends of the cylinders 25 of the bottle grippers 27 come into contact with the shoulders of the bottles C. At this time, the cap removers 30 take their positions above the bottles C and no contact is made with the bottles C. A further lowering of the holding head unit 3 causes to lower the arm 18; however, since the motion of the bottom plate 23 is restricted due to the contact between the cylinders 25 and the bottles C, only the top plate 21, which is integral with the arm 18, moves downward against the recovery force of the spring 41, and finally the cap removers 30 come into engagement with the bottles C, the state of which is clearly shown in FIG. 7.

Thereafter, when the arm 18 starts to move upward as guided by the cam rail 16, the top plate 21, together with the cap removers 30, moves upward while keeping the bottom plate 23 at its lower position by means of the spring 41. This relative motion causes to remove crown caps 40, if any, from the bottles C, as shown in FIG. 8. While, at any appropriate time subsequent to the contact between the cylinders 25 of the bottle grippers 27 and the shoulders of the bottles C, compressed air is supplied to the elastic members 26 to firmly grip the bottles C. FIG. 8 shows the state in which the elastic members 26 are expanded due to the supply of compressed air and the bottles C are firmly gripped. Therefore, when the holding head unit 3 moves upward, the bottles C are taken out of a box B.

Figure 9:
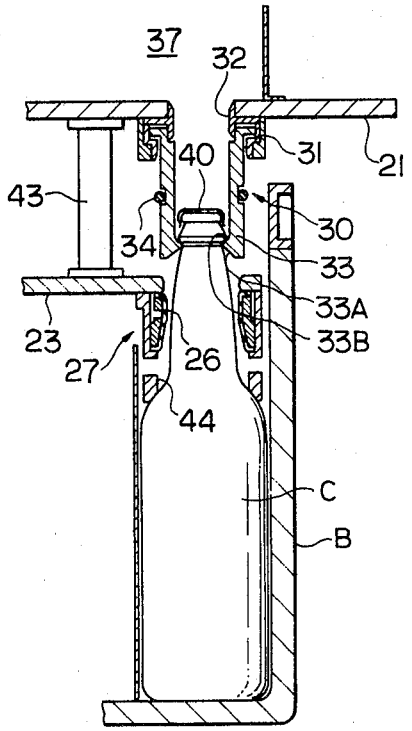
FIG. 9 is a cross-sectional view showing a part of still another embodiment in accordance with the present invention.
Figure 10:
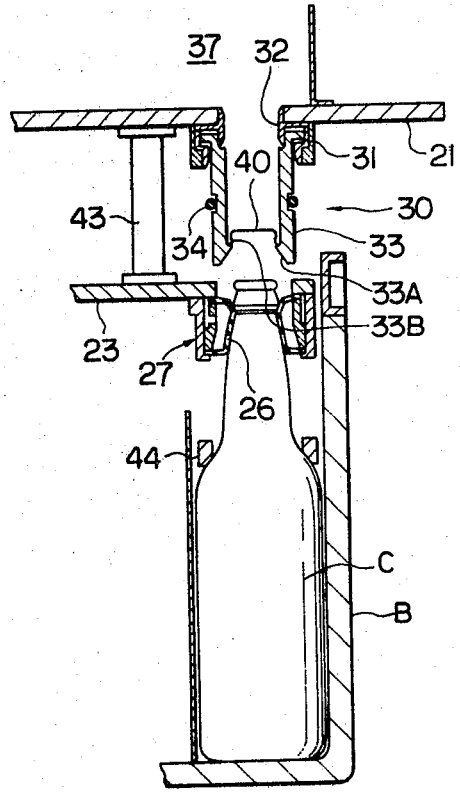
FIG. 10 is a cross-sectional view showing a state different from the one shown in FIG. 9.

FIGS. 9 and 10 show still another embodiment of the present invention. Similarly with the one shown in FIGS. 7 and 8, this embodiment also has only two plates, i.e., a top plate 21 provided with a plurality of cap removers 30 and a bottom plate 23 provided with a plurality of bottle grippers 27. However, as different from the previous embodiment, the top plate 21 and the bottom plate 23 of this embodiment are fixedly connected by a connection rod 43. Thus, there is no relative positional change between the top plate 21 and the bottom plate 23, and, therefore, between the cap removers 30 and the bottle grippers 27. It should be noted that, in accordance with this embodiment, holding members 44 are provided to temporarily hold the bottles C during the removal of crown caps 40 from the bottles C by the cap removers 30.

Explanation as to the operation of the embodiment shown in FIGS. 9 and 10 will follow. FIG. 9 shows the state in which the holding head unit 3 has been lowered and the top portions of the bottles C have been inserted in the cap removers 30. In this state, the holding members 44 rest on the shoulders of the bottles C, thereby keeping the bottles C at their current positions temporarily. The holding members 44 are connected to the bottom plate 23 through a relative position control mechnism (not shown). The relative position control mechanism is intended to control the relative positional relation between the holding members 44 and the bottom plate 23. Any suitable prior art means may be applied to the relative position control mechanism. For example, the spring means as shown in FIGS. 8 and 9, or various other alternatives such as cam means or cylinder actuator means may be applicable.

Since the bottles C are constrained by the holding members 44, although the cap removers 30 and the bottle grippers 27 start to move upward, the bottles C stay inside a box B without motion. Further upward motion of the cap removers 30 causes to remove crown caps 40, if any, from the bottles C, as shown in FIG. 10. Then, after supplying compressed air to the elastic members 26 to grip the bottles C, the holding head unit 3 moves upward to take the bottles C out of the box B.

As described in detail above, in accordance with the present invention, a cap removing operation takes place during an uncasing operation. Therefore, the present invention makes it possible to carry out an efficient bottle handling operation as well as to shorten the entire bottle handling line.

While the above provides a full and complete disclosure of the preferred embodiments of the present invention, various modifications, alternate constructions and equivalents may be employed without departing from the true spirit and scope of the invention. For example, the present invention should not be limited to the particular cap removers or bottle grippers described in the specification. The elastic members may be replaced with any prior art mechanical means. Moreover, instead of using the resilient ring 34, any spring means may be provided between the inner and outer rings 31,32 to attain the same function. Therefore, the above description and illustration should not be construed as limiting the scope of the invention, which is defined by the appended claims.

What is claimed is:

1. An apparatus for uncasing and uncapping bottles, comprising:

(a) a movable holding head unit including a bottom plate provided with a plurality of bottle grippers and a top plate fixedly connected to said bottom plate, wherein each of said bottle grippers includes cylinder means and elastic member means provided on the inner surface of said cylinder means and the bottom end of each of said cylinder means is engageable with a part of a bottle stored in a box when said unit is located at a lowered position;

(b) means for moving said holding means unit between a first position where a plurality of bottles, some of which may have caps thereon, are contained in a box and a second position where said bottles are placed with the caps removed and in an uncased condition;

(c) means for vertically moving said holding head unit while said unit moves between said first and second positions; and (d) means, attached to said holding head unit, for removing caps from the bottles while being transferred from the first position to the second position, said means for removing caps including an intermediate plate interposed between said top and bottom plates, said intermediate plate being movable with respect to said top and bottom plates in order to carry out a cap removing operation and provided with cap removers corresponding in position to respective said bottle grippers.

2. The apparatus of claim 1 further comprising a double-acting cylinder actuator for moving said intermediate plate with respect to said top and bottom plates in order to carry out a cap removing operation.

3. The apparatus of claim 1 wherein said means for removing caps includes coaxially aligned outer and inner rings attached to said intermediate plate; a plurality of fingers circumferentially arranged with their top ends pinched between said outer and inner rings; and a resilient ring fitted onto the outer cylindrical surface defined by said fingers.

4. The apparatus of claim 3 wherein each of said fingers is provided with a tapered surface at its bottom end as a guide.

5. The apparatus of claim 3 or 4 wherein each of said fingers includes an inwardly projecting hook portion which is engageable with a cap attached on top of a bottle.

6. An apparatus for uncasing and uncapping bottles, comprising:

(a) a movable holding head unit comprising a top plate and a bottom plate provided with a plurality of bottle grippers, wherein each of said bottle grippers includes cylinder means and elastic member means provided on the inner surface of said cylinder means and the bottom end of each of said cylinder means is engageable with a part of a bottle stored in a box when said unit is located at a lowered position;

(b) means for moving said holding head unit between a first position where a plurality of bottles, some of which may have caps thereon, are contained in a box and a second position where said bottles are placed with the caps removed and in an uncased condition;

(c) means for vertically moving said holding head unit while said unit moves between said first and second positions; and (d) means for removing caps from the bottles while being transferred from the first position to the second position, said means for removing caps including cap removers provided with said top plate corresponding in position to respective said bottle grippers, whereby the relative positional relation between said bottle grippers and said cap removers is changed by changing the relative positional relation between said top plate and said bottom plate in order to carry out a cap removing operation.

7. The apparatus of claim 6 wherein said top and bottom plates are connected by a connection rod having flanges on both ends and a coil spring interposed between said two plates.

8. An apparatus for uncasing and uncapping bottles, comprising:

(a) a movable holding head unit comprising a bottom plate provided with a plurality of bottle grippers and a top plate fixedly connected to said bottom plate, wherein each of said bottle grippers includes cylinder means and elastic member means provided on the inner surface of said cylinder means and the bottom end of each of said cylinder means is engageable with a part of a bottle stored in a box when said unit is located at a lowered position;

(b) means for moving said holding head unit between a first position where a plurality of bottles, some of which may have caps thereon, are contained in a box and a second position where said bottles are placed with the caps removed and in an uncased condition;

(c) means for vertically moving said holding head unit while said unit moves between said first and second positions; and (d) means for removing caps from the bottles while being transferred from the first position to the second position, said means for removing caps including cap removers provided with said top plate corresponding in position to respective said bottle grippers and holding means disposed below each of said bottle grippers for holding the bottles in position during a cap removing operation, whereby said top and bottom plates are moved upward with keeping the bottles stationary by said holding means to remove the caps from said bottles and then said elastic member is inflated to grip the neck of the bottles.

* * * * *

UNITED STATES PATENT AND TRADEMARK OFFICE

CERTIFICATE OF CORRECTION

PATENT NO. : 4,363,204

DATED : Dec. 14, 1982

INVENTOR(S) : Ohude et al.

It is certified that error appears in the above—identified patent and that said Letters Patent is hereby corrected as shown below:

Column 4, line 35, after "removers" and before "tends", insert --30--.

Column 7, line 5, replace "holding means unit" with --holding head unit--.

Signed and Sealed this

*Twenty-second* Day of *February 1983*

[SEAL]

*Attest:*

GERALD J. MOSSINGHOFF

*Attesting Officer*

*Commissioner of Patents and Trademarks*